US006602094B1

(12) United States Patent
Wang

(10) Patent No.: US 6,602,094 B1
(45) Date of Patent: Aug. 5, 2003

(54) ELECTRICAL CABLE CONNECTOR

(76) Inventor: Juei-Li Wang, No. 177, Ta-Chiao 2nd St., Yung-Kang City, Tainan Hsien (TW)

( * ) Notice: Subject to any disclaimer, the term of this patent is extended or adjusted under 35 U.S.C. 154(b) by 0 days.

(21) Appl. No.: 10/124,904

(22) Filed: Apr. 18, 2002

(51) Int. Cl.[7] ..... H01R 13/40
(52) U.S. Cl. ..... 439/598; 439/686
(58) Field of Search ..... 439/686, 598, 439/695, 701, 350, 357, 358

(56) References Cited

U.S. PATENT DOCUMENTS 4,380,361 A * 4/1983 Asick et al. ..... 439/358
4,786,261 A * 11/1988 Ramos, Jr. ..... 439/686
4,846,723 A * 7/1989 Pong ..... 739/456
5,449,302 A * 9/1995 Yarbrough et al. ..... 439/680
6,139,363 A * 10/2000 Ko et al. ..... 439/579

* cited by examiner

*Primary Examiner*—Hien Vu
(74) *Attorney, Agent, or Firm*—Brian T. Sattizahn; McNees Wallace & Nurick LLC

(57) ABSTRACT

An electrical cable connector includes a socket body having two opposite side faces, each of which is formed with a first retaining recess that extends in a longitudinal direction, and a second retaining recess that extends in a transverse direction relative to the longitudinal direction. A cable sleeve extends from a rear end of the socket body, and includes an inner housing and two opposite latch members extending outwardly from two opposite sides of the inner housing. Each of the latch members has a longitudinal portion that is fittingly disposed in a respective one of the first retaining recesses in the side faces, and a transverse portion that extends from the longitudinal portion in the transverse direction and that is fittingly disposed in a respective one of the second retaining recesses in the side faces so as to limit movement of the inner housing relative to the socket body.

5 Claims, 5 Drawing Sheets

ELECTRICAL CABLE CONNECTOR

BACKGROUND OF THE INVENTION

1. Field of the invention

This invention relates to an electrical cable connector, more particularly to an electrical cable connector having a socket body and a cable sleeve connected to the socket body.

2. Description of the Related Art

FIGS. 1 to 4 illustrate a conventional electrical cable connector that includes a socket body 11, a plurality of terminals 131 mounted in the socket body 11, a cable 17 with a plurality of cable wires 13 that have end portions respectively connected to the terminals 131, and a cable sleeve 12 connected to the socket body 11 and enclosing the end portions of the cable wires 13. The socket body 11 has two opposite sides formed with opposing retaining recesses 113. The cable sleeve 12 includes an inner housing 16 and two latches 161 projecting from the inner housing 16 and disposed in the retaining recesses 113 so as to retain the inner housing 16 on the socket body 11. A plastic encapsulant 121 is extruded onto and encloses the inner housing 16 and the latches 161 for protecting the cable wires 13 from dust and moisture. The conventional electrical cable connector is disadvantageous in that the latches 161 tend to be undesirably removed from the retaining recesses 113 prior to the extrusion of the encapsulant 121 onto the inner housing 16 and the latches 161.

SUMMARY OF THE INVENTION

Therefore, the object of the present invention is to provide an electrical cable connector that is capable of overcoming the aforementioned drawback of the prior art.

According to the present invention, an electrical cable connector comprises: a socket body having opposite front and rear ends, two opposite side faces extending between the front and rear ends, and a plurality of terminal passages formed in the socket body and extending from the rear end to the front end, each of the opposite side faces being formed with a first retaining recess that extends from the rear end toward the front end in a longitudinal direction, and a second retaining recess that extends in a transverse direction relative to the longitudinal direction; a plurality of terminals received in the terminal passages, respectively; a plurality of cable wires having end portions connected to the terminals, respectively; and a cable sleeve connected to and extending from the rear end of the socket body and sleeved around the end portions of the cable wires. The cable sleeve includes an inner housing that surrounds the end portions of the cable wires and that has a front end. The cable sleeve further includes two opposite latch members extending outwardly from two opposite sides of the front end of the inner housing. Each of the latch members has a longitudinal portion that is fittingly disposed in a respective one of the first retaining recesses in the side faces, and a transverse portion that extends from the longitudinal portion in the transverse direction and that is fittingly disposed in a respective one of the second retaining recesses in the side faces so as to limit movement of the inner housing relative to the socket body.

BRIEF DESCRIPTION OF THE DRAWINGS

In drawings which illustrate an embodiment of the invention.

DETAILED DESCRIPTION OF THE PREFERRED EMBODIMENT

Figure 1:
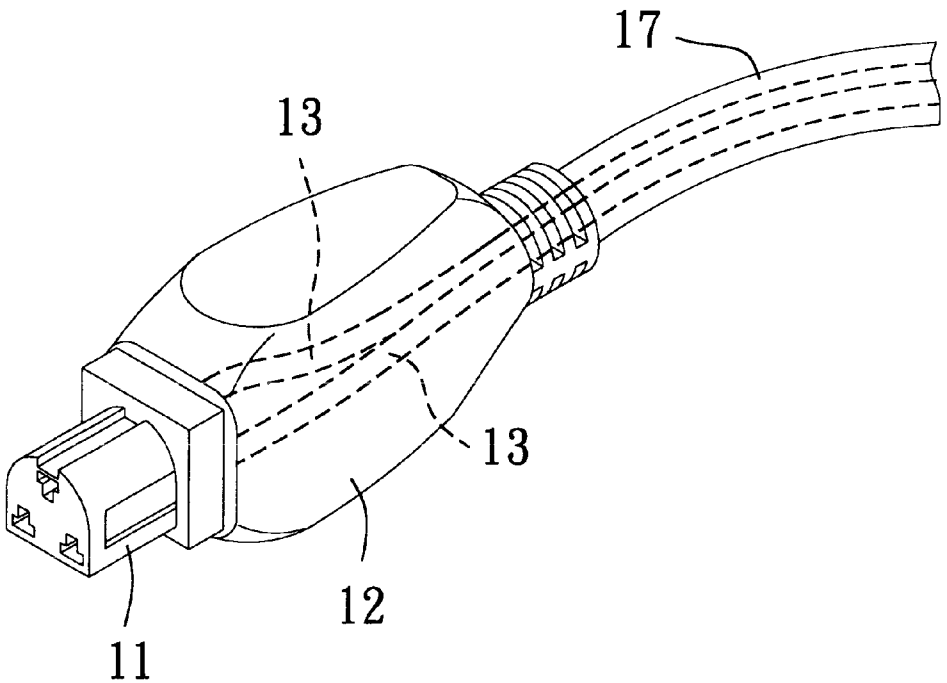
FIG. 1 PRIOR ART
FIG. 1 is a perspective view of a conventional electrical cable connector.
Figure 2:
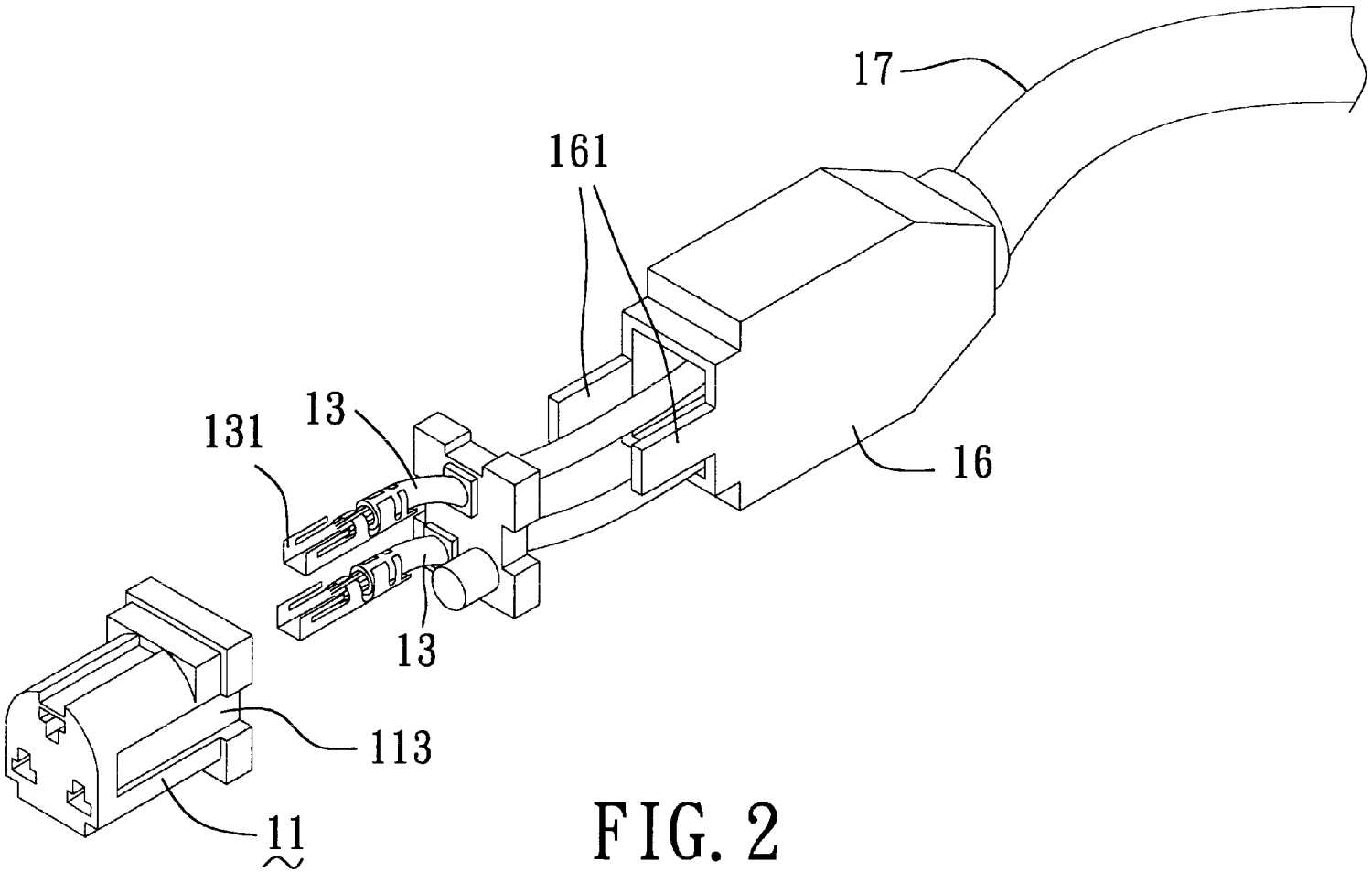
FIG. 2 PRIOR ART
FIG. 2 is a fragmentary exploded perspective view of the electrical cable connector of FIG. 1.
Figure 3:
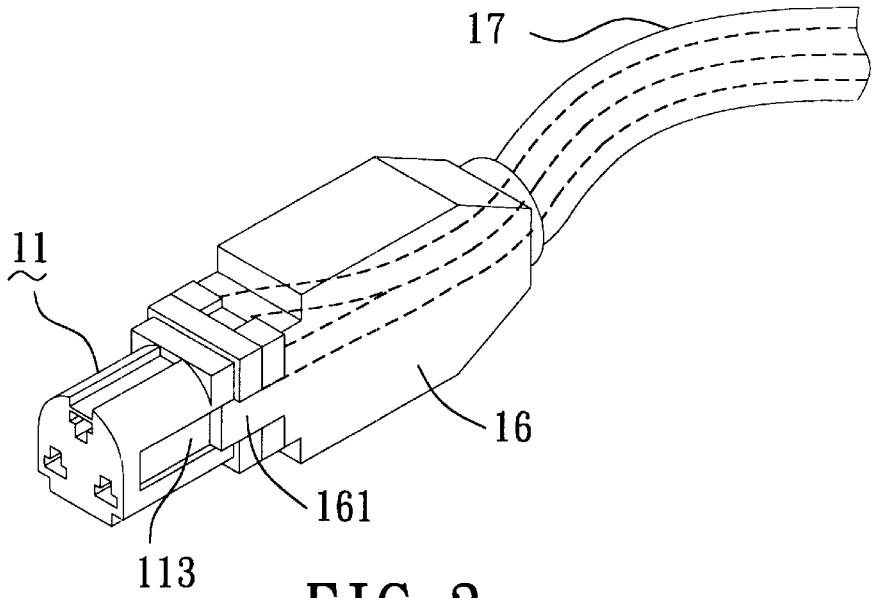
FIG. 3 PRIOR ART
FIG. 3 is a fragmentary perspective view of the electrical cable connector of FIG. 2.
Figure 4:
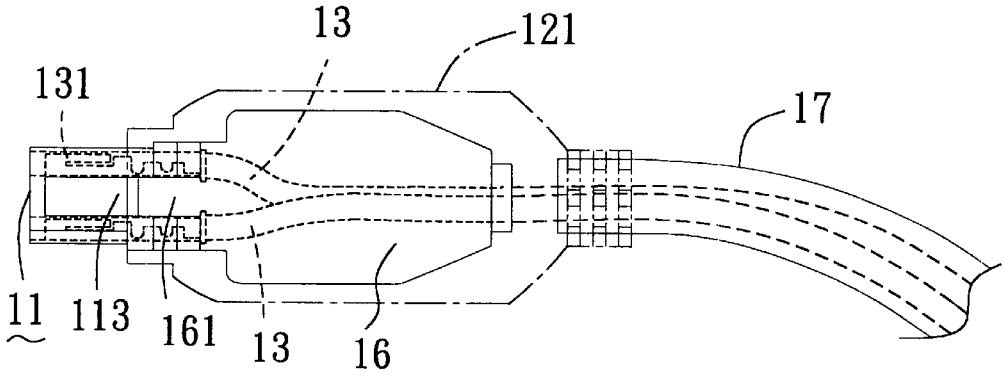
FIG. 4 PRIOR ART
FIG. 4 is a schematic side view of the electrical cable connector of FIG. 1.
Figure 5:
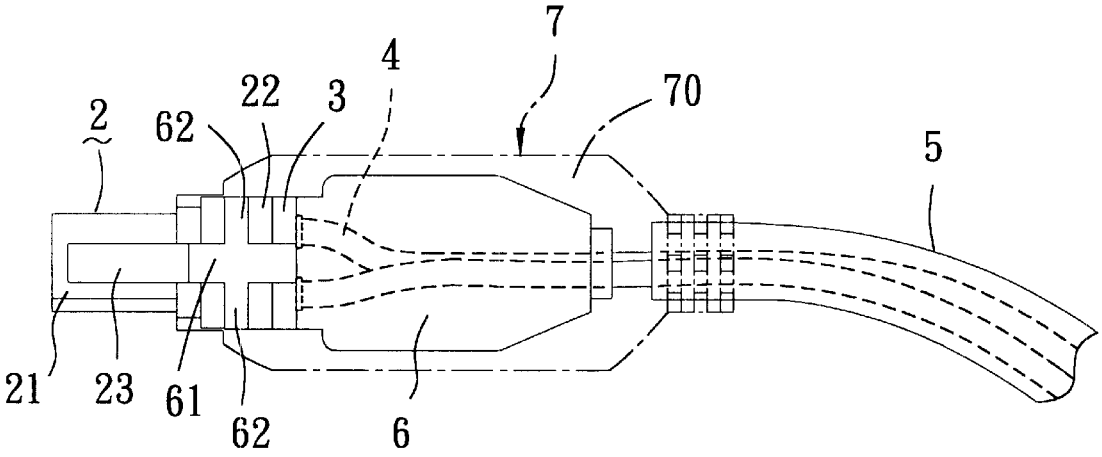
FIG. 5 is a schematic side view of an electrical cable connector embodying this invention.
Figure 6:
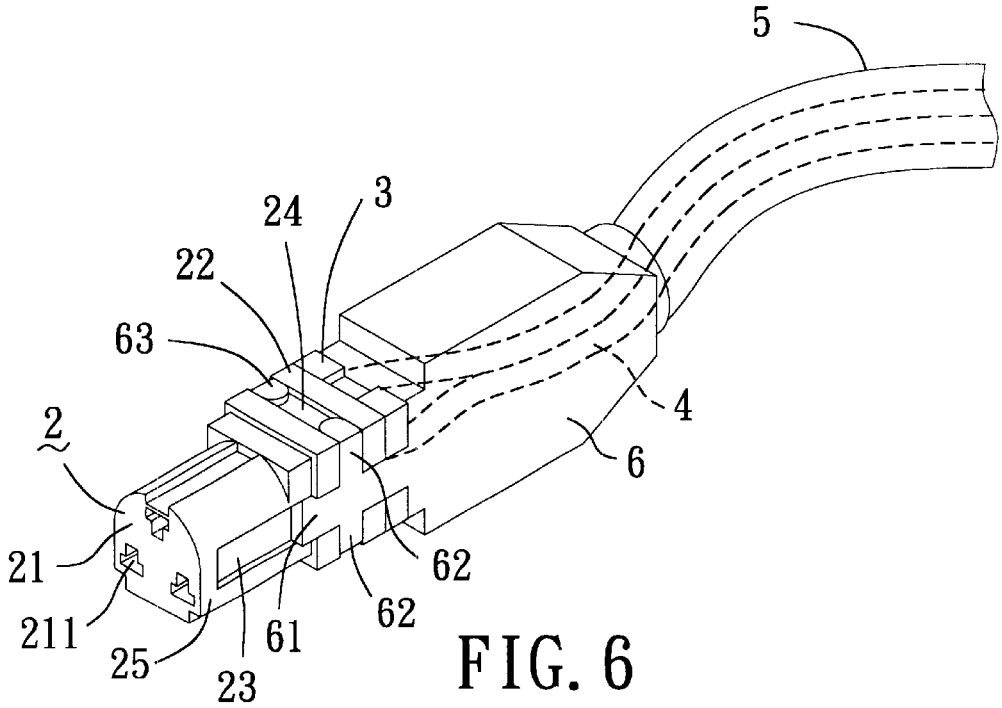
FIG. 6 is a fragmentary perspective view of the electrical cable connector of FIG. 5.
Figure 7:
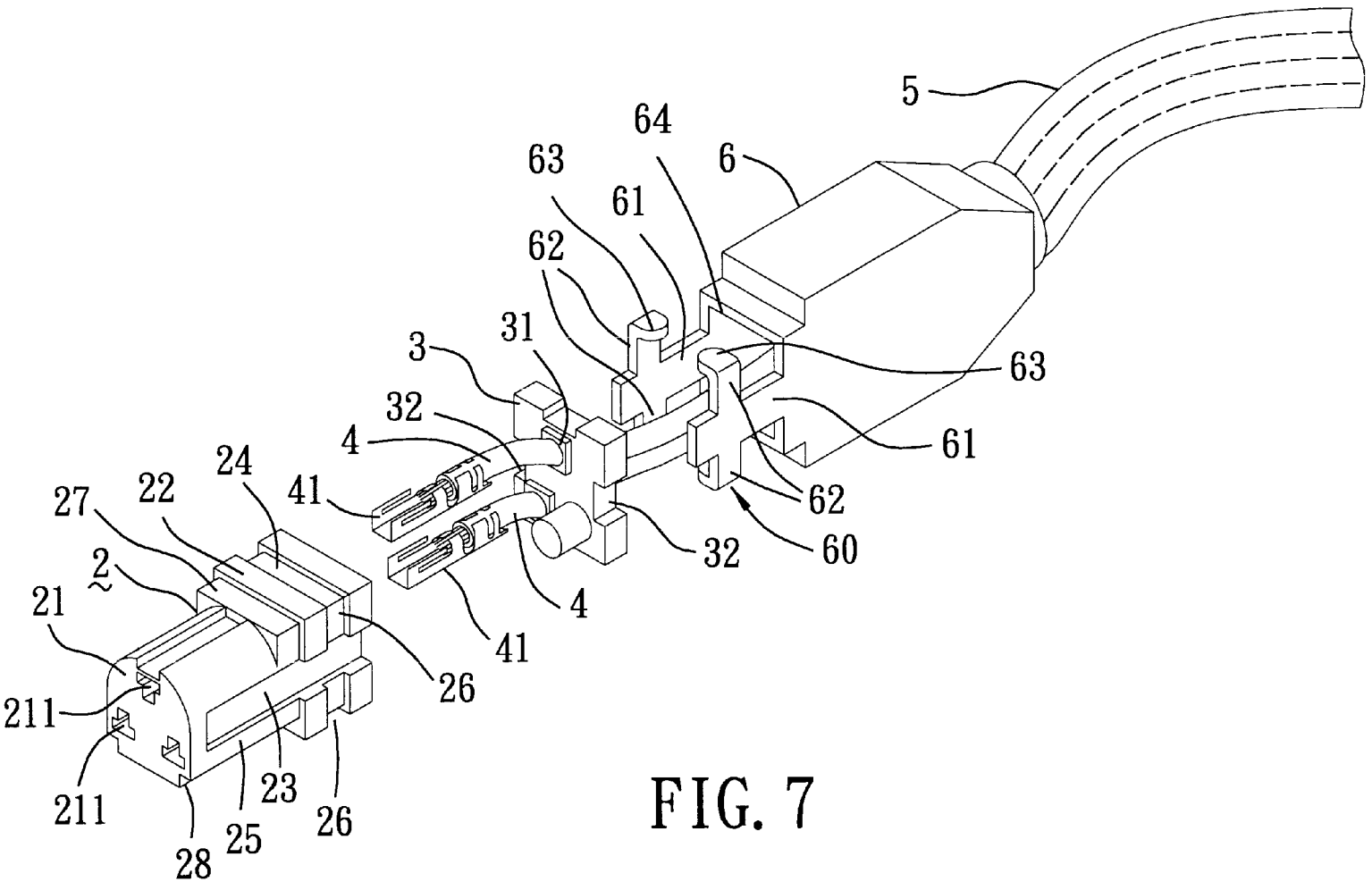
FIG. 7 is a fragmentary exploded perspective view of the electrical cable connector of FIG. 6.

FIGS. 5 to 7 illustrate an electrical cable connector embodying this invention.

The electrical cable connector includes: a socket body 2 having opposite front and rear ends 21, 22, two opposite side faces 25 extending between the front and rear ends 21, 22, and a plurality of terminal passages 211 formed in the socket body 2 and extending from the rear end 22 to the front end 21, each of the opposite side faces 25 being formed with a first retaining recess 23 that extends from the rear end 22 toward the front end 21 in a longitudinal direction, and a second retaining recess 26 that extends in a transverse direction relative to the longitudinal direction; a plurality of terminals 41 received in the terminal passages 211, respectively; a cable 5 with a plurality of cable wires 4 having end portions connected to the terminals 41, respectively; and a cable sleeve 7 connected to and extending from the rear end 22 of the socket body 2 and sleeved around the end portions of the cable wires 4. The cable sleeve 7 includes an inner housing 6 that surrounds the end portions of the cable wires 4 and that has a front end 64. The cable sleeve 7 further includes two opposite latch members 60 extending outwardly from two opposite sides of the front end 64 of the inner housing 6. Each of the latch members 60 has a longitudinal portion 61 that is fittingly disposed in a respective one of the first retaining recesses 23 in the side faces 25, and a transverse portion 62 that extends from the longitudinal portion in the transverse direction and that is fittingly disposed in a respective one of the second retaining recesses 26 in the side faces 25 so as to limit movement of the inner housing 6 relative to the socket body 2. Each of the first retaining recesses 23 is intersected by a respective one of the second retaining recesses 26.

The socket body 2 further has top and bottom faces 27, 28, each of which is formed with a third retaining recess 24 extending in a direction transverse to the longitudinal and transverse directions. Each of the second retaining recesses 26 extends between the top and bottom faces 27, 28 to spatially communicate with the third retaining recesses 24 in the top and bottom faces 27, 28. Each of the latch members 60 further includes two anchored portions 63 that are bent from two opposite ends of the transverse portion 62 and that are fittingly disposed in the third retaining recesses 24.

The cable sleeve 7 further includes a cover 3 that is interposed between the rear end 22 of the socket body 2 and the front end 64 of the inner housing 6 and that is formed with a plurality of positioning holes 31 for passage of the cable wires 4, and two opposite recesses 32 for passage of the longitudinal portions 61 of the latch members 60, respectively.

The cable sleeve 7 further includes an encapsulant 70 that is extruded onto and that encloses the inner housing 6, the cover 3, and the latch members 60.

With the inclusion of the transverse portions 62 and the anchored portions 62 in the latch members 60, the aforesaid drawback encountered in the prior art can be eliminated.

With the invention thus explained, it is apparent that various modifications and variations can be made without departing from the spirit of the present invention. It is therefore intended that the invention be limited only as recited in the appended claims.

I claim:

1. An electrical cable connector comprising:

a socket body having opposite front and rear ends, two opposite side faces extending between said front and rear ends, and a plurality of terminal passages formed in said socket body and extending from said rear end to said front end, each of said opposite side faces being formed with a first retaining recess that extends from said rear end toward said front end in a longitudinal direction, and a second retaining recess that extends in a transverse direction relative to said longitudinal direction;

a plurality of terminals received in said terminal passages, respectively;

a plurality of cable wires having end portions connected to said terminals, respectively; and a cable sleeve connected to and extending from said rear end of said socket body and sleeved around said end portions of said cable wires, said cable sleeve including an inner housing that surrounds said end portions of said cable wires and that has a front end, said cable sleeve further including two opposite latch members extending outwardly from two opposite sides of said front end of said inner housing, each of said latch members having a longitudinal portion that is fittingly dispsoed in a respective one of said first retaining recesses in said side faces, and a transverse portion that extends from said longitudinal portion in said transverse direction and that is fittingly disposed in a respective one of said second retaining recesses in said side faces so as to limit movement of said inner housing relative to said socket body.

2. The electrical cable connector of claim 1, wherein each of said first retaining recesses is intersected by a respective one of said second retaining recesses.

3. The electrical cable connector of claim 2, wherein said socket body further has top and bottom faces, each of which is formed with a third retaining recess extending in a direction transverse to said longitudinal and transverse directions, each of said second retaining recesses extending between said top and bottom faces to spatially communicate with said third retaining recesses in said top and bottom faces, each of said latch members further including two anchored portions that are bent from two opposite ends of said transverse portion and that are fittingly disposed in said third retaining recesses.

4. The electrical cable connector of claim 3, wherein said cable sleeve further includes a cover that is interposed between said rear end of said socket body and said front end of said inner housing and that is formed with a plurality of positioning holes for passage of said cable wires, and two opposite recesses for passage of said longitudinal portions of said latch members.

5. The electrical cable connector of claim 4, wherein said cable sleeve further includes an encapsulant that is extruded onto and that encloses said inner housing, said cover, and said latch members.

* * * * *